US007943878B2

(12) United States Patent
Hamm

(10) Patent No.: US 7,943,878 B2
(45) Date of Patent: May 17, 2011

(54) OPERATING DEVICE FOR AN ELECTRICAL APPLIANCE AND CONTROL PANEL

(75) Inventor: Wolfgang Alfred Hamm, Bretten (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 0 days.

(21) Appl. No.: 12/690,490

(22) Filed: Jan. 20, 2010

(65) Prior Publication Data

US 2010/0181175 A1 Jul. 22, 2010

(30) Foreign Application Priority Data

Jan. 22, 2009 (DE) ..... 10 2009 006 434

(51) Int. Cl.
*H01H 9/00* (2006.01)

(52) U.S. Cl. ..... 200/316

(58) Field of Classification Search ..... 200/316, 200/313, 310, 5 A, 296, 293, 314, 5 R, 336
See application file for complete search history.

(56) References Cited

U.S. PATENT DOCUMENTS

| | | | | |
|---|---|---|---|---|
| 4,800,466 | A | 1/1989 | Bauer et al. | |
| 4,807,091 | A | 2/1989 | Obata | |
| 5,093,764 | A | 3/1992 | Hasegawa et al. | |
| 5,594,222 | A | 1/1997 | Caldwell | |
| 6,224,221 | B1 | 5/2001 | Glienicke | |
| 6,410,866 | B1 | 6/2002 | Klein et al. | |
| 7,041,922 | B2 * | 5/2006 | Geiger et al. | 200/296 |
| 2004/0109304 | A1 | 6/2004 | Yokoyama et al. | |
| 2005/0067268 | A1 * | 3/2005 | Hurrle | 200/314 |
| 2005/0077166 | A1 | 4/2005 | Kim et al. | |
| 2005/0284741 | A1 | 12/2005 | Suzuki | |
| 2010/0025214 | A1 * | 2/2010 | Roose et al. | 200/5 A |

FOREIGN PATENT DOCUMENTS

| | | | |
|---|---|---|---|
| DE | 37 02 291 | A1 | 8/1988 |
| DE | 42 22 335 | A1 | 1/1994 |
| DE | 10 2004 026 836 | A1 | 12/2005 |
| DE | 10 2005 057 025 | A1 | 1/2007 |
| DE | 10 2006 039 196 | B3 | 10/2007 |
| DE | 10 2006 049 474 | A1 | 6/2008 |
| EP | 0 176 817 | A1 | 4/1986 |
| EP | 1 752 853 | A1 | 2/2007 |

OTHER PUBLICATIONS

German Office Action for German Appllication No. 10 2009 006 434.6.
Search Report for European Application No. 09178900 dated Jul. 19, 2010.

* cited by examiner

*Primary Examiner* — Edwin A. Leon
(74) *Attorney, Agent, or Firm* — Alston & Bird LLP

(57) ABSTRACT

An operating device for an electrical appliance with a control panel has a control element for operation through rotary actuation arranged in the control panel, said control element being disposed and mounted in a receptacle behind the control panel. The receptacle has light-conducting and/or light transmitting material in the manner of a light guide, and is illuminated through an LED at a posterior end facing away from the control panel and with light apertures provided at another anterior end on the control panel around the control element extending forwardly beyond the control panel.

15 Claims, 3 Drawing Sheets

OPERATING DEVICE FOR AN ELECTRICAL APPLIANCE AND CONTROL PANEL

CROSS REFERENCE TO RELATED APPLICATIONS

This application claims priority to German Patent Application Number 10 2009 006 434.6, filed on Jan. 22, 2009, the contents of which are incorporated by reference.

FIELD OF THE INVENTION

The invention relates to an operating device for a household electrical appliance, as well as a corresponding control panel.

BACKGROUND OF THE INVENTION

Operating devices for household electrical appliances are known in numerous forms. The great majority of them, as known for instance from EP 1 318 534 A1, are receptacles arranged on, or behind, a control panel, and in which a control element, for instance a rotary knob, is mounted. This may be retractable under certain circumstances. A rotary switch device is arranged behind on the receptacle and is operated through the rotary knob. Openings may be provided in the control panel for optical display purposes, behind which LEDs or other lighting means are arranged. Through this, for instance, an operating state may be displayed on the operating device.

SUMMARY

An object of the invention is to create an operating device of the afore-mentioned type that has further functions and with which a simple construction can be advantageously achieved.

This object is met through an operating device as claimed herein, together with a corresponding control panel as claimed herein. Advantageous and preferred embodiments of the invention are the subject of further claims and are described in more detail below. The wording of the claims is made content of the description through express reference.

The control element is disposed in/contained in a receptacle behind the control panel. It can advantageously be mounted in it in such a way that it can rotate and also possibly be contained in one embodiment as a retractable control element. In accordance with an embodiment of the invention, the receptacle has light-conducting and/or light-transmitting material in the form of a light guide, and can therefore guide light. It is particularly advantageous if the receptacle substantially comprises such material. The receptacle is illuminated by lighting means at one posterior end facing away from the control panel, i.e., light is coupled into it. Light apertures are arranged at another anterior end of the receptacle on the control panel, especially around the control element or alternatively within the control element, so that light can exit from the front or is visible from the front. This enables, as a first function, the possibility that the receptacle accommodates the control element, or that the control element is mounted in the receptacle. The second function of the receptacle, since it is advantageously manufactured from a plastic, is to act as a light guide. This dispenses with the need for further openings in the control panel and only that opening is necessary in which the receptacle is anyway arranged. Further advantages are provided by the further advantageous embodiments described below.

In another embodiment of the invention, the receptacle has a plurality of light-conducting segments, or is subdivided into such segments, in a longitudinal direction and/or the light-conducting direction, i.e., from its posterior end, at which for instance a switching element, actuated through a control panel, is provided, in the direction of the anterior end. A subdivision is advantageously achieved through non-light-conducting segments or inserts and/or longitudinal sections. Then, depending on the arrangement of the light apertures at the front on the control panel, the light-conducting segments and/or sections may be smaller than the non-light-conducting ends or vice versa. The non-light-conducting segments and/or longitudinal sections are advantageously substantially smaller or narrower so that on the whole the greatest part of the receptacle serves as a light guide. Such non-light-conducting segments and/or longitudinal sections should be arranged for complete separation of neighbouring light-conducting longitudinal sections, and so to speak extend over the entire length of the receptacle from the posterior end to the anterior end.

The lighting means advantageously radiate light in the light-conducting direction and/or in the afore-mentioned longitudinal extension of the receptacle into it, or is arranged in such a way to it.

In a further advantageous embodiment of the invention, wherein the receptacle is subdivided into a plurality of segments and/or longitudinal sections, at least one lighting means is provided on each of the segments. The lighting means of different segments and/or longitudinal sections are then preferentially controllable independently of one another and may have different colours or generate different colours. It is thus possible that with, for example, four longitudinal sections of the receptacle four light apertures are formed on the anterior side of the operating device, which are then activated depending on state and possibly having different colours. If the length of the receptacle in the light-conducting direction differs, then it is sufficient, for instance, to have light from one lighting means for a somewhat uniform appearance of light at the light aperture.

The afore-mentioned receptacle with light-conducting and non-light-conducting regions can be advantageously manufactured through two-component injection moulding. Under certain circumstances, the same plastic may be used and is usually light-conducting and correspondingly coloured only for the non-light-conducting regions and/or subdivisions. An alternative manufacturing method is to group together a plurality of individual parts with light-conducting and non-light-conducting properties to form the receptacle, with the parts advantageously welded to one another or bonded through adhesive.

In another embodiment of the invention, the light apertures may be narrow and have a circular segment-like and/or circular form arranged around the control panel. This can lead, above all, to a functional state of the electrical appliance, to which the operating device belongs.

In an alternative embodiment of the invention, the light apertures can have a circular shape or circular segment shape, although with a considerable width. In particular, the width may be at least half the diameter of the control element so that all of the light apertures together may form a type of sleeve or wide ring around the control element on the control panel. This enables not only a lighting or optical display over a large area, but also, for example, through non-light-transmitting printing on the surface of such a wide-area light aperture a certain display of information, namely certain symbols or the like.

The receptacle advantageously has a somewhat cup-like shape, and can be in some embodiments, for instance, have a round and circumferentially shape of a section of pipe. It is open at the anterior end towards the control panel, and can advantageously have the afore-mentioned sleeve-like or collar-like form with extension outwardly to the side. It can be substantially closed to the posterior end and have only one opening for a shaft on which the control element sits on the one hand and possibly is secured to it and through which on the other hand a switching device is controlled or rotated. Such a shaft does not have to be continuous and can, for example, comprise several parts. In general, a control element, for instance a retractable rotary knob, can also comprise several parts, in particular to realise the retracting mechanism.

The switching device, which is operated through the control element, can be advantageously secured to the posterior end of the receptacle, in particular along the longitudinal direction of the receptacle. A possible constructive form of such a receptacle is described, for instance, in EP 1 318 534 A1, to which explicit reference is made here, also in respect of a possible mounting of the afore-mentioned shaft in the receptacle. The switching device can be secured to the receptacle through bolts, clips or the like.

In another advantageous embodiment of the invention, the operating device may be formed such that it can be inserted as a separate component in a control panel of an electrical appliance, or in a corresponding opening. For this the aforementioned light apertures or collar-like sections in particular can come to lie in corresponding recesses or cavities of the control panel, so that it remains flush on the anterior side. Wide collar-like sections on the receptacle also have the advantage that they enable mounting and/or securing of the receptacle to the control panel in a manner that is particularly stabile against tilting.

In an alternative embodiment the entire control panel together with the receptacle may be manufactured as a single part, for instance through multi-component injection moulding.

In a further embodiment of the invention, light-conducting means can be provided that extend from the receptacle into the control element and are guided to one anterior side or outer side of the control element. These light-conducting means can commence at the posterior end of the receptacle and have corresponding light-emitting means. Alternatively, they can radiate light from the side, for instance from the circular or collar-like sections described above, into the control element. So, for instance, a particular rotary position of the control element can be displayed. Such light-conducting means can also be integrated or injection moulded in the control element or in the receptacle, for instance as light-conducting regions, similarly to the way described above for the receptacle.

These and further characteristics are derived from the claims and also from the description and the drawings, and the individual characteristics either individually or together in the form of sub-combinations are realized in various embodiments of the invention and in other areas and can advantageously represent embodiments that are protectable in their own right and for which protection is claimed here. The division of the application into intermediate headings and individual sections does not limit the general validity of the statements made thereunder.

BRIEF DESCRIPTION OF THE DRAWINGS

Example embodiments of the invention are shown schematically in the drawings and described in more detail below. The drawings are.

DETAILED DESCRIPTION

Figure 1:
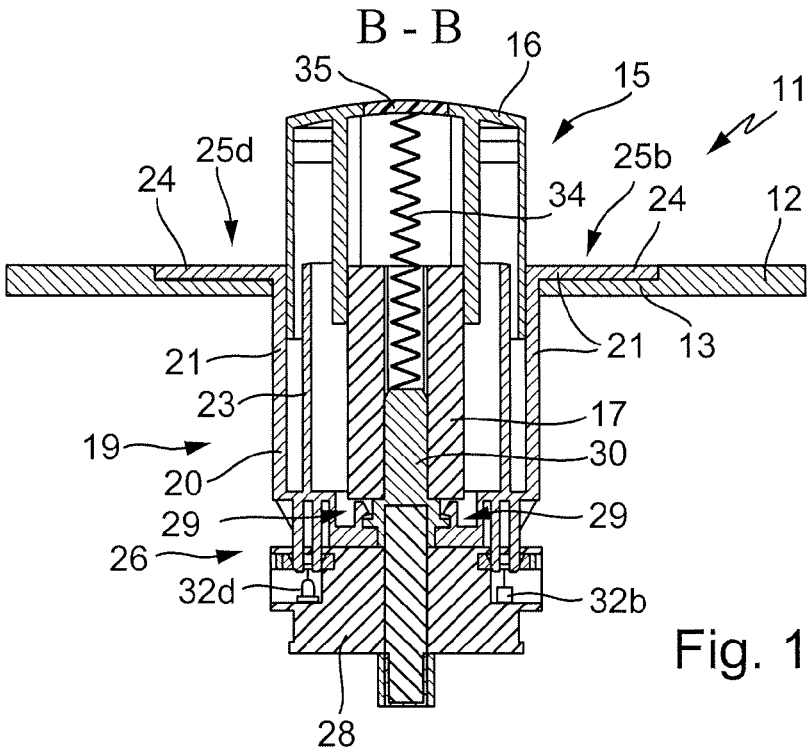
FIG. 1 illustrates a section through an operating device in a control panel with receptacle and switching device attached thereto.
Figure 2:
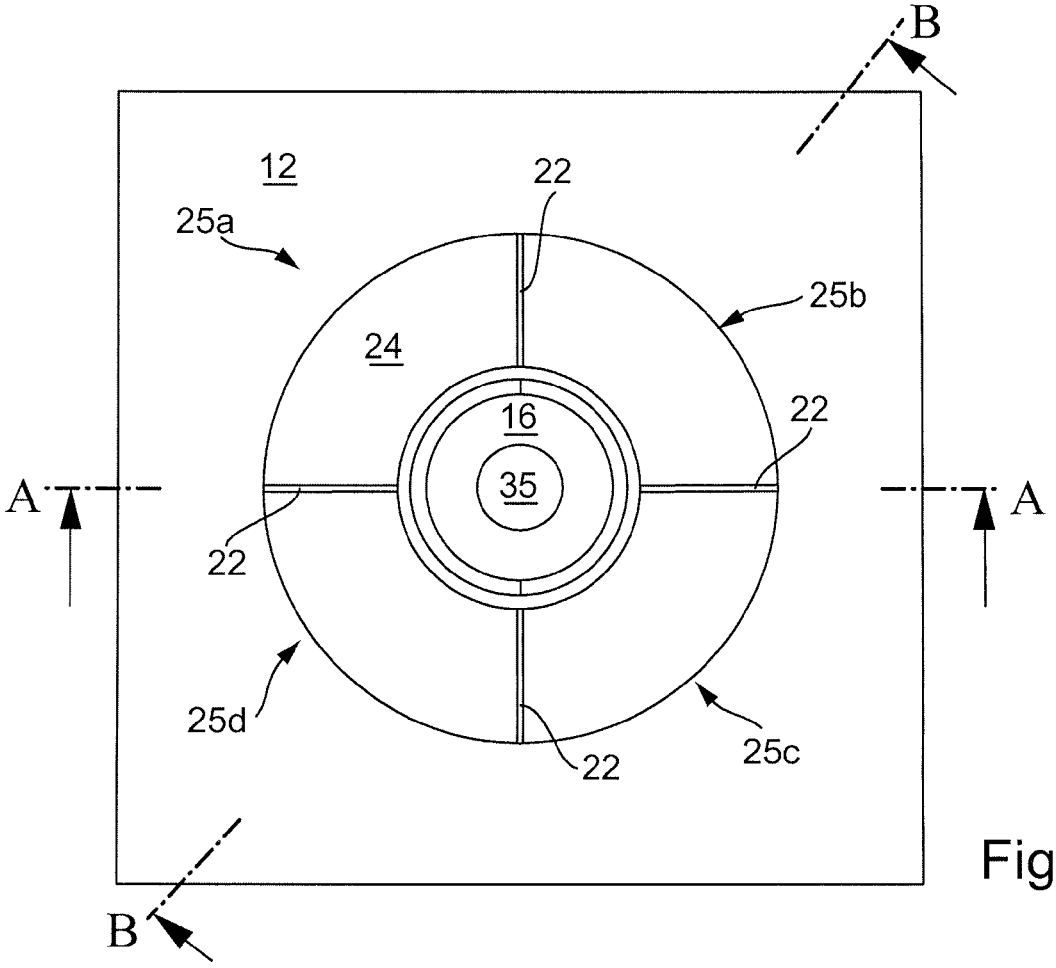
FIG. 2 illustrates a top view of the operating device from FIG. 1.

FIG. 1 shows an operating device 11 according to the invention, as it can be used on the anterior side in a control panel 12 of an electrical appliance, for instance an electric oven. The control panel 12 has a correspondingly formed recess 13 which, as shown in FIG. 2 also, has a round and stepped form for flush insertion of the operating device 11 in the control panel 12.

Figure 3:
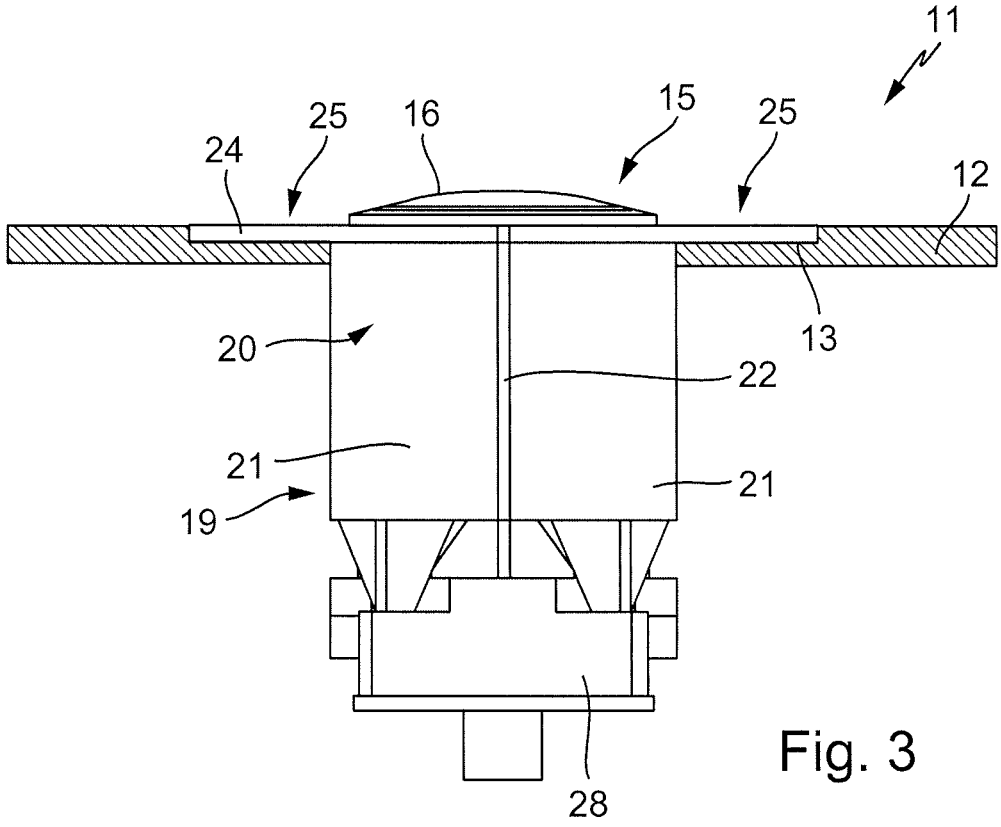
FIG. 3 illustrates a side view of the operating device from FIG. 1 in a non-cut state of the operating device.
Figure 4:
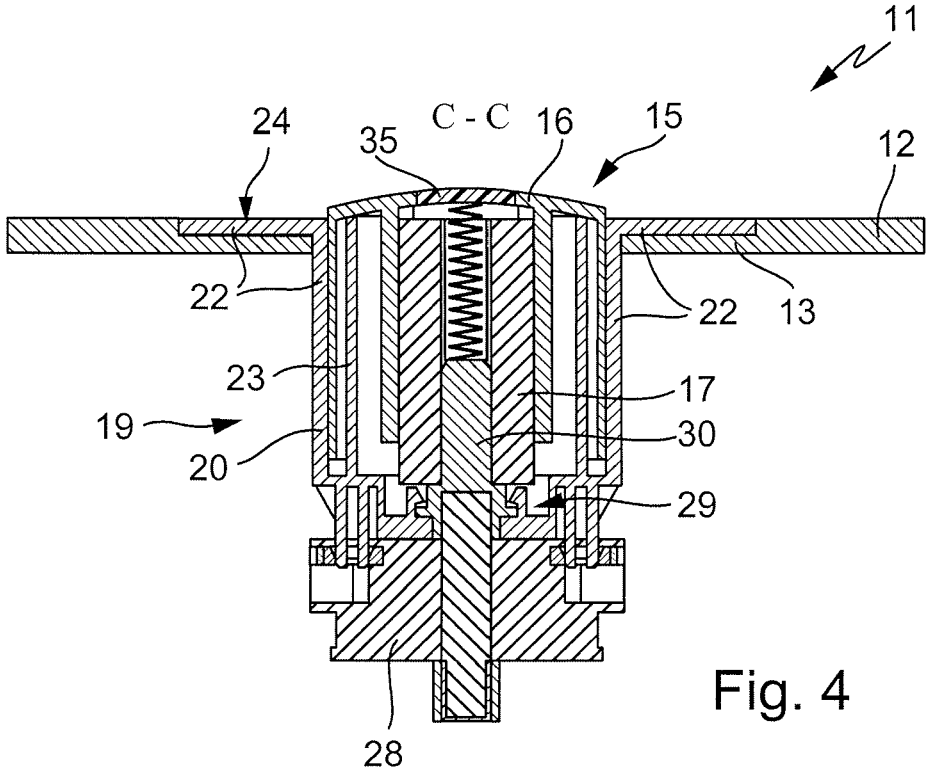
FIG. 4 illustrates a representation similar to FIG. 1 along the cut line C-C from FIG. 2

The operating device 11 has a rotary knob 15 as a control element. The rotary knob 15 has a grip part 16 that projects beyond the control panel 12 and which is mounted on a base part 17. The operating device 11 and/or rotary knob 15 are in the form of retractable knobs so that, as shown in FIGS. 3 and 4, the grip part 16 can be displaced onto the base part 17 by pressing and then projects to only a very minor extent beyond the control panel 12. The corresponding mechanism for this will be familiar to a person skilled in the art and does not need to be explained further.

The rotary knob 15 is mounted or fixed in a receiving cup 19. The receiving cup 19 has an outer jacket 20 that is advantageously cylindrical and round circumferential, as well as a corresponding inner jacket 23. The lower part of the grip part 16 or, substantially the entire grip part 16 corresponding to FIG. 4, is in the space between the outer jacket 20 and inner jacket 23. The outer jacket 20 and inner jacket 23 are connected to each other, are advantageously a single part and in particular are manufactured at the same time and/or with one another.

To the front the receiving cup 19 or the outer jacket 20 has a collar-like extension 24, which forms a circular ring. This can be seen in the top view in FIG. 2. The circular ring-like, collar-like extension 24 is divided into 4 fields of illumination 25*a* to 25*d*. This is described in more detail below.

A rotary switch device 28 is secured to a posterior end 26 of the receiving cup 19 in a usual manner in accordance with the afore-mentioned EP 1 318 534 A1. The rotary switch device 28 also has the usual form, for instance in accordance with EP 1 898 184 A1. In particular it is a so-called Grey Code switch.

A support 29 is disposed on the rear-facing end 26 of the receiving cup as known from the afore-mentioned EP 1 318 534 A1. An axle stub 30 is mounted on this support 29 so that it can rotate, but is fixed in an axial direction. This axle stub 30 ensures transfer of the rotation from the grip part 16 to the rotary switch device 28.

A lighting means 32*d* is arranged on the left and a lighting means 32*b* is arranged on the right in the rotary switch device 28, especially LEDs. Reference is made to these in the afore-mentioned EP 1 898 184 A1, wherein the lighting means 32 either have the same control/same plug connection as the rotary switch device 28 or a separate one.

The light from the left lighting means 32*d* is coupled on the left into the outer jacket 20 of the receiving cup 19. For this it comprises light-conducting material 21, as well as the corresponding illuminated field 25*d*. The inner jacket 23 can also comprise light-conducting material, but this is of secondary importance.

The largest part of the outer jacket 20 can be substantially of light-conducting material 21. As is clearly seen in FIG. 2, both the outer jacket 20 and the illuminated fields 25*a* to *d* can be subdivided into four regions or sectors. This subdivision is formed through separating strips 22 of non-light-conducting material. These separating strips 22 may be manufactured as a single piece with the rest in the region of the collar-like extension 24, in particular through two-component injection moulding. They can extend from the collar-like extension 24, i.e., between the illuminated fields 25, through the outer jacket 20 of the receiving cup 19 to the posterior end in front of the lighting means 32. The separating strips 22 therefore bring about a division into four of the light-conducting material 21 as shown in FIG. 2 in a direction in the drawing plane. A lighting means 32, arranged behind each light-conducting region in accordance with section B-B, which can be seen in the sectional view in FIG. 1, sits approximately centrally when viewed in a circumferential direction and radiates light into one of the light guides formed so to speak as a result and which then exits frontally at the illuminated fields 25*a* to 25*d*.

A greater or smaller number of divisions may be provided in place of the division into four shown here. A corresponding number of lighting means then has to be provided, wherein in a further development of the invention, more than one lighting means, for instance more than one LED, is provided per illuminated field 25.

In the side view shown in FIG. 3 it can be seen how two regions of the receiving cup 19 and/or its outer jacket 20 comprise light-conducting material 21. They are, however, separated through a separating strip 22, which also extends seamlessly through the collar-like extension 24 and therefore also separates the illuminated fields 25 from one another and prevents over-illumination.

In the sectional view shown in FIG. 4 according to section A-A in FIG. 2, the cut goes directly through the plane of two separating strips 22. This is also recognisable through the different hatching in the region of the separating strips 22 and on the outer jacket 20 as well as on the collar-like extension 24. Furthermore, it can be seen that the separating strips 22 are also provided on the inner jacket 23 to bring about complete separation of adjoining circular ring segments. If the grip part 16, however, is of non-light-transmitting material, then it does not matter if it is illuminated through the inner jacket 23 extending within it.

Through any desired control of the lighting means 32, in principle also fully independently of whether the rotary knob 15 is pressed in or is in an out position, it is possible to control whether one or more of the illuminated fields 25*a* to 25*d* is illuminated. As already described, some of the lighting means 32 can be coloured, so that the illuminated fields 25 may be illuminated in different colours.

Whilst the afore-mentioned two-component injection moulding is the preferred manufacturing method for such a receiving cup 19, of corresponding light-conducting material 21 with separating strips 22 in between, other possibilities are also conceivable. For instance, a plurality of parts of the same type can be grouped together to form a receiving cup 19, with possible interspersion of non-light-conducting layers or parts. Alternatively, for instance, laser irradiation of the receiving cup manufactured from actual light-conducting material along the separating strips could change it such that light is no longer conducted here or that sectors so to speak can no longer be overcome.

The spring 34, recognisable in the sectional views, of metal and connected to a metal button disposed on the anterior side of the grip part 16, can be electrically contacted through an axle stub 30 that is also electrically conducting. This enables a capacitive touch switch to be created in accordance with US 2007/0181410 A1.

Reference is also drawn to the German patent application DE 102009006421.4 lodged at the same priority date by the same applicant.

Figure 5:
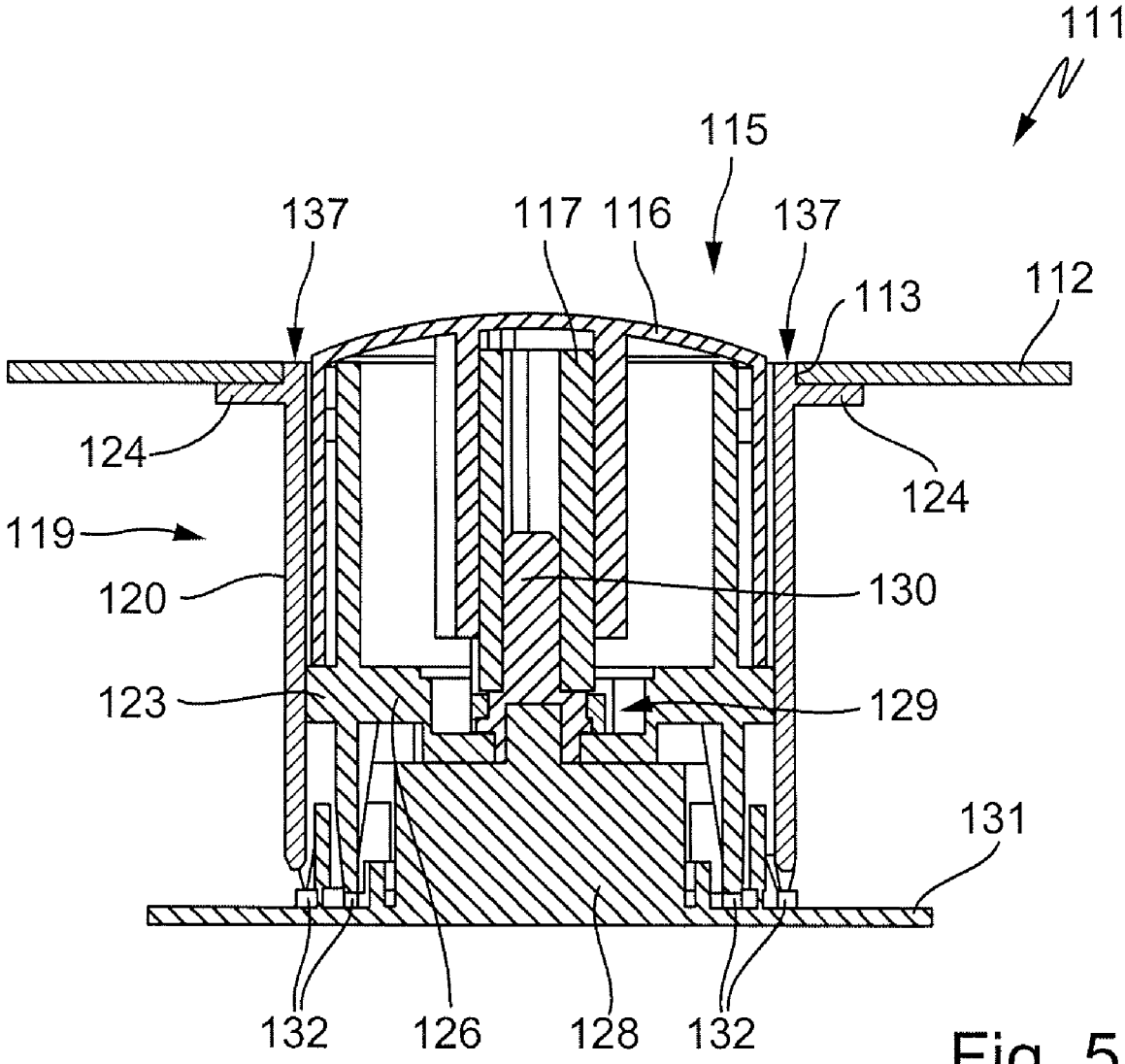
FIG. 5 illustrates a further sectional view similar to FIG. 4 with a receiving cup in a different form.

An alternative operating device 111 is shown in FIG. 5, in which a rotary knob 115 is again disposed in a control panel 112 or cut-out section 113. This rotary knob 115 is also in the form of a rotary retractable knob and is only shown in a retracted state, a grip part 116 is therefore pushed onto a base part 117.

The receiving cup 119 here is without a collar-like extension as before, and instead has only its front face 137 in the cut-out section 113. This yields, through the front face 137, a narrow ring that encircles the grip part 116. A collar-like extension 124 is displaced a little downwardly and serves to secure the receiving cup 119 in a stabile and non-tiltable manner to the control panel 112. It cannot, however, be seen from the front.

It can also be seen that an outer jacket 120, that becomes the afore-mentioned collar-like extension 124, is substantially of pipe section form and is not manufactured as a single part with an inner jacket 123 of the receiving cup 119, but instead is disposed on top of it and is advantageously connected to it or bonded to it. Here too, a rear-facing end 126 of the receiving cup 119, in this case within the outer jacket 120, is connected to a rotary switch device 128. An axle stub 130 is mounted in a support 129 and in turn engages in the base part 117 of the rotary knob 115. In addition, it should further be noted that the rotary switch device 128 is disposed on a circuit board 131 and in particular is also electrically connected. The circuit board 131 also bears lighting means 132, advantageously in the form of LEDs and/or SMD LEDs.

Not shown in FIG. 5 are corresponding separating strips between the light-conducting material, which substantially forms the outer jacket 120 and the inner jacket 123. This can, however, have a form analogous to the previous embodiments.

Above all, however, it is possible or envisaged with an operating device 111 according to FIG. 5 for the outer jacket 120 and inner jacket 123 of the receiving cup 119 to be connected to one another in a non-light-conducting manner, and for this reason different lighting means 132 are provided. They can be separated by a coating or intermediate layers. So, for instance, the coupling of light into the outer jacket 120 can bring about a narrow, circular segment-like light appearance at the front faces 137 on the control panel 112, with a division that embraces a 90° elbow angle similar to FIG. 2, or less or more. The illumination of the inner jacket 123 can be used to create an optical display through lights on the anterior side of the grip part 116. For this the anterior side of the grip part 116 can be formed from corresponding light-transmitting material. So, for example, different functional states of the operating device 111 can also be shown on the rotary knob 115. Illumination of the knob on the one hand or the control panel on the other hand can, in line with the general concept of the invention, be achieved together or only individually. Above all, different illuminations and different colours can thus be generated.

Furthermore, a segmentation of the inner jacket 123 and outer jacket 120 through corresponding separating strips can be different, in particular through angular displacement, relative to one another. This enables any desired illuminated representation to be achieved.

The invention claimed is:

1. An operating device for an electrical appliance with a control panel and a control element arranged in said control panel for operation through rotary actuation of said control element, wherein said control element is a retractable rotary knob with a rotary switching device on a posterior end of said receptacle, wherein said control element is disposed in a receptacle behind said control panel and is mounted in said control panel, wherein said receptacle has light-conducting and/or light-transmitting material in the manner of a light guide and is illuminated through lighting means at said posterior end facing away from said control panel, wherein light apertures facing forwards are provided and disposed on an anterior end of said receptacle on said control panel, around said control element, or in said control element.

2. The operating device according to claim 1, wherein said light apertures are narrow and are formed around said control element in a circular ring segment form.

3. The operating device according to claim 1, wherein collar-like sections are provided projecting outwards from said receptacle to a side, said collar-like sections being formed as one piece with said receptacle and are in form of flat light apertures.

4. The operating device according to claim 1, wherein said rotary switch device is secured to said receptacle for support on said operating device.

5. Control panel for an electrical appliance with an operating device according to claim 1, wherein said operating device is inserted in an opening in said control panel and is secured therein.

6. The operating device according to claim 1, wherein said receptacle has a plurality of light-conducting segments in a light-conducting direction from said posterior end of said receptacle to said anterior end divided in a circumferential direction through non-light-conducting inserts and/or longitudinal sections, such that separate and/or different light apertures are formed at said anterior end of said receptacle.

7. The operating device according to claim 6, wherein at least one said lighting means is disposed on each of said light-conducting segments, wherein said lighting means of different light-conducting segments are controllable independently of one another.

8. The operating device according to claim 6, wherein said receptacle is manufactured from light-conduction regions and non-light-conducting regions through two-component injection moulding.

9. The operating device according to claim 1, wherein said receptacle is cup-like and round, and is formed circumferentially in the manner of a pipe.

10. The operating device according to claim 9, wherein said receptacle is substantially closed at said posterior end aside from an opening for a shaft on which said control element is fixed, said shaft connecting it to a switching device fixed to said posterior end.

11. The operating device according to claim 1, wherein it is insertable as a separate component in a control panel, wherein said receptacle is also insertable into said control panel.

12. The operating device according to claim 11, wherein it is insertable flush in said control panel.

13. The operating device according to claim 1, wherein light-conducting means are provided from said receptacle around said control element, into said control element, and on an anterior side or outer side of said control element.

14. The operating device according to claim 13, wherein said light-conducting means are integrated or injection moulded into said control element.

15. The operating device according to claim 14, wherein said light-conducting means are integrated or injection moulded into said receptacle.

* * * * *